United States Patent [19]

Kakko-Chiloff

[11] Patent Number: 4,919,046

[45] Date of Patent: Apr. 24, 1990

[54] OFFSET PRINTING APPARATUS OPERATING IN TANDEM

[75] Inventor: Nicolas Kakko-Chiloff, Montrouge, France

[73] Assignees: Usinage Montage et Assistance Technique "U.M.A.T." , Loiret; Conseil Vente Service, Seine Saint Denis, both of France

[21] Appl. No.: 285,161

[22] Filed: Dec. 16, 1988

[30] Foreign Application Priority Data

Dec. 18, 1987 [FR] France ..... 87 17752

[51] Int. Cl.[5] ..... B41F 7/08; B41F 13/32

[52] U.S. Cl. ..... 101/143; 101/177

[58] Field of Search ..... 101/177, 218, 219, 178, 101/217, 179–185, 221, 225, 247, 139, 140–145, 352, 152

[56] References Cited

U.S. PATENT DOCUMENTS

| | | | |
|---|---|---|---|
| 1,414,107 | 4/1922 | Wood et al. | 101/221 |
| 1,545,194 | 7/1925 | Morris et al. | 101/221 |
| 2,425,167 | 8/1947 | Whitehead | 101/221 |
| 4,369,705 | 1/1983 | Gelinas | 101/177 |

*Primary Examiner*—J. Reed Fisher

*Attorney, Agent, or Firm*—Browdy and Neimark

[57] ABSTRACT

Two plate cylinders have horizontal and transverse axes placed respectively on either side of a vertical plane passing by axes of a touching cylinder and a blanket cylinder. A support is mounted between the touching cylinder and the blanking cylinder and is provided for the two plate cylinders, being tiltably mounted about the axis of the blanket cylinder. Two starting cylinders have horizontal and transverse axes disposed respectively slightly below and outside with respect to each plate cylinder. Control means control a tilting motion of the support of the plate cylinders for setting under pressure each of the plate cylinders and for rotatively driving the starting cylinders.

7 Claims, 5 Drawing Sheets

OFFSET PRINTING APPARATUS OPERATING IN TANDEM

FIELD OF THE INVENTION

The present invention relates to an offset printing apparatus operating in tandem.

BACKGROUND OF THE INVENTION

It is conventional in the commercial printings made by rotary printing apparatus of the blanket type to personalize the prints. This personalization is obtained by means of the tilting in operation from one printing group to another. The printing groups operate then in tandem, meaning that while one group is in the printing process, the other group is stopped in order to change the printing plate, and this without stopping the printing line which continues its operation. Frequent stops on such a printing line would actually be very damaging due to the loss of time and the waste of paper due to starting operations.

With such installations, when the printing group which is stopped has been equipped with a new printing plate and when the personalization printing is completed on the other printing group which is in use, a starting and setting in register under pressure of the merely equipped group is begun, while the pressure of the group which has completed a printing is released and unclutched in order to replace its printing plate. This type of printing machine has already been developed and generally involves typographic or flexographic printing techniques which are easy to put in practice. However, typographic and flexographic printing plates are costly, and require a photoengraving installation which the printers using offset apparatus usually do no possess. The present wish of printers is therefore that these so-called "tandem" machines are equipped with the offset printing process, the printing plates of which are cheap and easy to make. However, the carrying into effect of an offset printing is complex since it implies a delicate ink adjustment, a moistening setting (ink-water balance), an accurate setting of the touch, a preparation of the plates and blankets prior to the printing and an accurate setting of the stroke.

OBJECT OF THE INVENTION

The present invention has for its object to solve the above mentioned problems by providing an offset tandem apparatus of a particularly simple design and reliable operation, due to a judicious disposition of the various printing, inking and moistening elements, on the one hand, and to the use of recent technical means such as a semi-continuous inking, an alcohol moistening on a touching device, the operations of which reduce the necessities of adjustment during printing.

SUMMARY OF THE INVENTION

In accordance with the above object and others that will become apparent in the discussion that follows, this offset printing apparatus operating in tandem includes a frame at the upper portion of which are mounted an inking device and a moistening device for respectively applying a film of ink and a film of moistening liquid on a touching cylinder with a horizontal axis, rotatively mounted on the frame and at the lower portion of which are rotatively mounted a blanket cylinder and a counter-cylinder, tangent together and between which passes a web to be printed, and the axes of which extend horizontally and transversely, that is to say perpendicularly to the web to be printed, the axis of the blanket cylinder and that of the touching cylinder being placed in a same vertical plane, and further comprising two plate cylinders with horizontal and transverse axes, placed respectively on either side of the vertical plane passing by the axes of the touching and blanket cylinders, at a level intermediate between these two cylinders, a support for the two plate cylinders, which is tiltably mounted about the axis of the blanket cylinder, two starting cylinders with horizontal and transverse axes, disposed respectively slightly below and outside with respect to each plate cylinder, and means for controlling the tilting motion of the support of the plate cylinders, for setting each of these cylinders under pressure and for rotatively driving the starting cylinders, in order to bring alternately each of the two plate cylinders either in a printing position in which it is in contact under pressure both with the upper touching cylinder and with the lower blanket cylinder after having previously started it in rotation at the same peripheral speed as that of the blanket cylinder and having keyed it in angular position, or in a stopped waiting position in which the plate cylinder is retracted from the touching and blanket cylinders and is bearing on the corresponding starting cylinder for enabling the changing of its printing plate.

The apparatus according to the invention has the advantage that there is no interruption of the pressure on the web when the printing passes from one series to the following one, and that there is then also no discontinuity of the inking and moistening operations.

BRIEF DESCRIPTION OF THE DRAWINGS

There will be described hereinafter, by way of non limiting example, an embodiment of the present invention with reference to the accompanying drawing, wherein.

DETAILED DESCRIPTION OF THE PREFERRED EMBODIMENT

Figure 1:
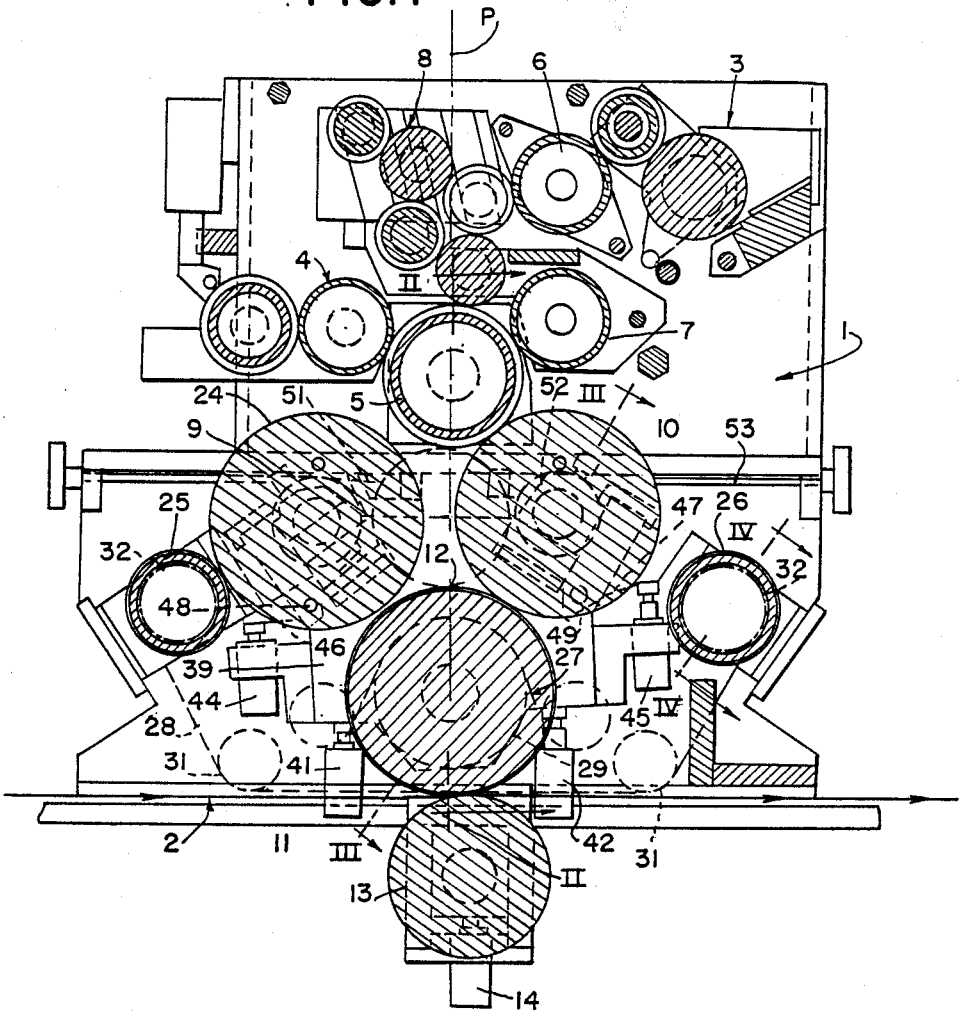
FIG. 1 is a vertical and longitudinal cross-sectional view, in the direction of movement of the printed web, of an offset tandem printing apparatus according to the invention.

The offset tandem printing apparatus according to the invention which is shown in FIG. 1 includes a frame 1 made of two uprights, vertical and longitudinal, that is to say parallel to the movement direction of a web 2 passing horizontally through the apparatus, at its lower portion, by moving from the left to the right in FIG. 1. This apparatus includes at its upper portion, in the conventional manner, an inking device 3 with a semi-continuous ink pick-up, an alcohol moistening device 4, an inking and moistening touching cylinder 5 of large diameter, two tables 6, 7 moved transversely for the distribution of the ink and erasure of the stagger marks and transfers, and a group of loading and distributing rollers 8, tangent together and with the touching cylinder 5. All these cylinders have axes, horizontal and transverse, that it to say perpendicular to the movement direction of the web 2, and are rotatively mounted at their ends on the uprights of the frame 1, directly or via support forming elements.

In its lower portion, the apparatus comprises two cylinders 9, 10 of horizontal and transverse axes, placed respectively on either side of the transverse vertical plane P passing through the axis of the touching cylinder 5, and each carrying an offset plate which can be fed with ink and water by the upper assembly ending by the touching cylinder 5. The two plate cylinders 9, 10 are situated below the touching cylinder 5, and they are set alternately in contact with this touching cylinder 5 according to the series which have to be printed. In the position shown in FIG. 1, the right hand plate cylinder 10 is in contact with the touching cylinder 5 and therefore intervenes for the printing of the current series, while the left hand side plate cylinder 9 is retracted from the touching cylinder 5, in a waiting position.

Below the two plate cylinders 9, 10 is disposed a cylinder 11 of horizontal and transverse axis fixed in space, contained in the vertical and transverse plane P, this cylinder 11 being coated with a blanket 12. Underneath the blanket cylinder 11 is disposed a counter-cylinder 13 of horizontal and transverse axis, and the web 2 to be printed moves between the blanket cylinder 11 and the counter-cylinder 13. This counter-cylinder 13 is pressed against the blanket cylinder 11 by mechanical, pneumatic or hydraulic means, such as vertical jacks 14, in such manner that the printing deposited by the offset plate of the plate cylinder 10, which is in the printing position, is perfectly transferred with a good touch by the blanket 12 on the web 2 to be printed.

The arrangement which has been described hereabove corresponds to that of an offset printing apparatus with three cylinders, which is conventional except that the blanket cylinder 11 is fixed in space while, in the known offset apparatus, it is generally the plate cylinder 9 or 10 which is fixed.

Figure 2:
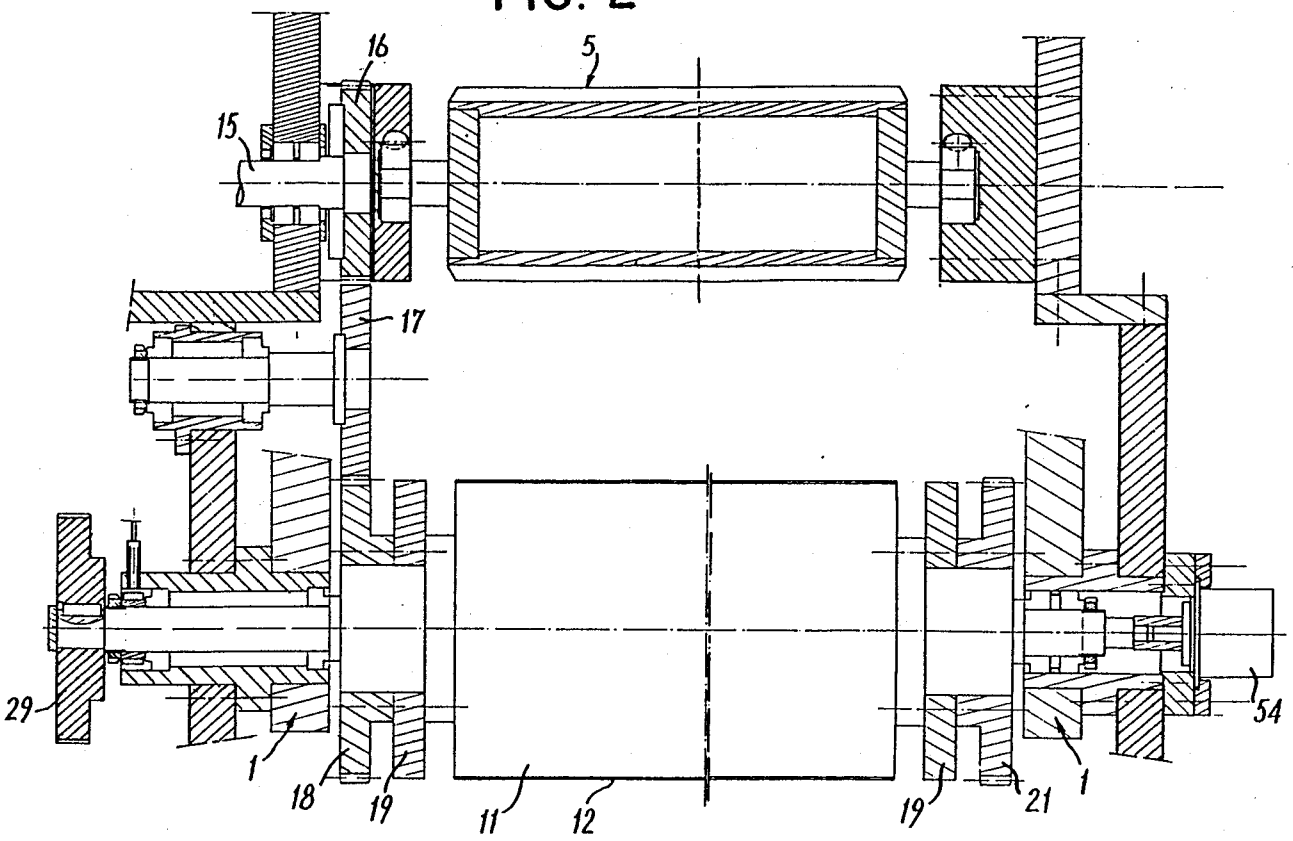
FIG. 2 is a cross-sectional made along line II—II of FIG. 1.

The blanket cylinder 11 is rotatively driven from a transverse shaft 15 via a train of gears 16, 17, 18 as shown in FIG. 2. The gear 16 is directly connected to the inking group via the shaft 15, the rotation of which is provided by the main shaft of the machine. The gear 17 is an intermediate gear, while the gear 18 is fixed to the blanket cylinder 11. The pitch diameter of the gear 18 corresponds exactly to the diameter of tapes 19 rigidly connected to the blanket cylinder 11 and, by way of consequence, to the diameter of the format developed by the printing. The pitch diameter of the gear 16 is determined in such a manner that the inking linear speed corresponds exactly to the printing linear speed.

Figure 3:
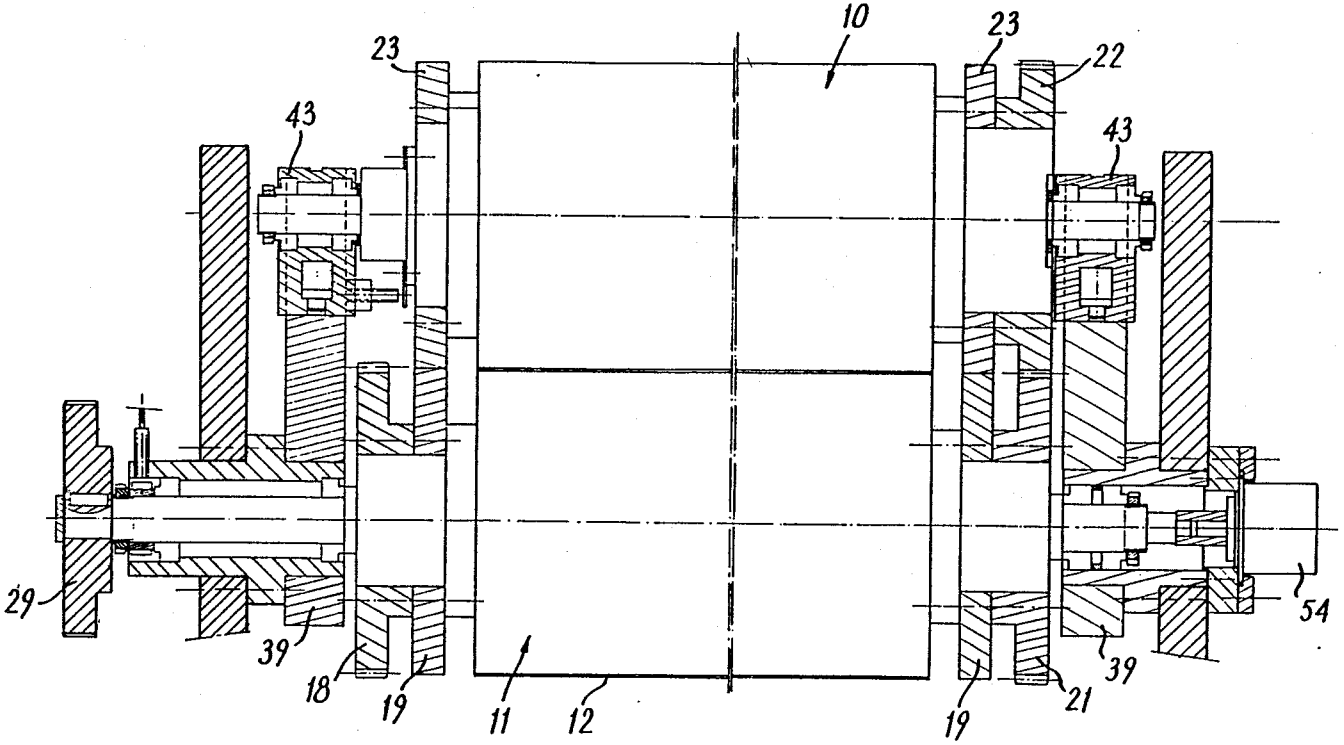
FIG. 3 is across-sectional view made along line III—III of FIG. 1.
Figure 4:
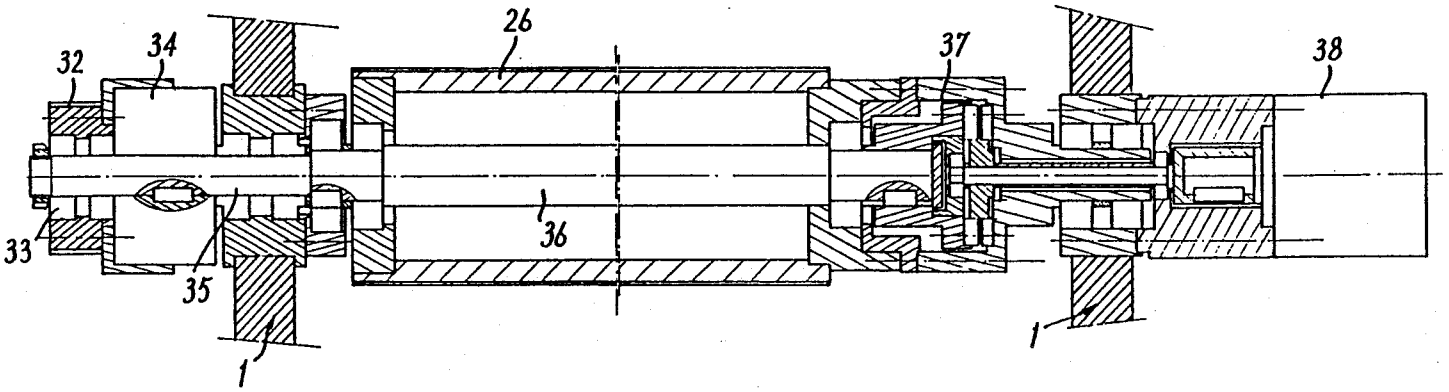
FIG. 4 is a cross-sectional view made along line IV—IV of FIG. 1.
Figure 5:
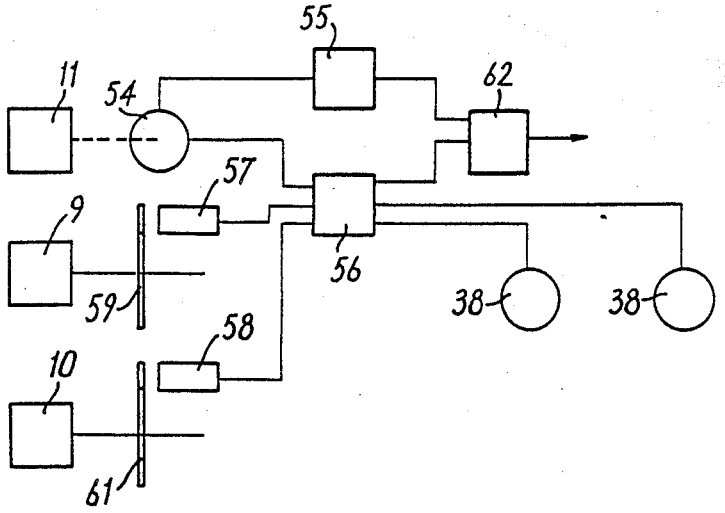
FIG. 5 is a block diagram of the control circuit.

As it may be seen in FIG. 3, the plate cylinder 10 which intervenes for the printing of the current series is rotatively driven from the blanket cylinder 11, via a gear 21 rigidly connected to the blanket cylinder 11 and a gear 22 rigidly connected to the plate cylinder 10. The pitch diameters of these gears are identical to that of the gear 18. On the other hand, each of the plate cylinders 9, 10 is rigidly connected to tapes 23 which are bearing, in the printing position, on the tapes 19 of the blanket cylinder 11. The other plate cylinder 9, which is in a waiting position, is not rotatively driven, and the gear 24, to which it is rigidly connected and which is identical to the gear 22, is not engaged with the gear 21 of the blanket cylinder 11. Moreover, it is pressed neither with the touching cylinder 3 nor with the blanket cylinder 11. However, it is bearing with a starting cylinder 25 coated with rubber. Another starting cylinder 26 is disposed on the other side of the blanket cylinder 11 and is symmetrical to the starting cylinder 25 with respect to the vertical and transverse plane passing by the axes of the touching cylinder 5 and blanket cylinder 11. The plate cylinder 10, which is active for the printing, is then retracted from the second starting cylinder 26.

The two starting cylinders 25, 26 are rotatively driven from the blanket cylinder 11 via a transmission mechanism 27 including a chain 28 passing on a toothed wheel 29 rigidly connected to the shaft of the blanket cylinder 11, on return toothed wheels 31 mounted on the frame 1 of the apparatus and on a toothed wheel 32 rigidly connected to the input shaft 33 of an electromagnetic clutch 34 the output shaft 35 of which is coupled to the shaft 36 of the starting cylinder 25 or 26. Each of the starting cylinders 25, 26 includes, moreover, a differential system 37 corrected by a servomotor 38. The kinematic chain thus formed is calculated so that the peripheral speed of each starting cylinder 25, 26 is identical to that of the blanket cylinder 11, when the servomotor 38 is stopped.

The two plate cylinders 9, 10 are mounted together, at each of their ends, on the same rocker arm 39 which is articulated about the axis of the blanket cylinder 11 and which bears on a pair of vertical jacks 41 and 42. On the rocker arm 39, the two plate cylinders 9, 10 are respectively carried by slides 43 which are pushed in pressure by respective jacks 44, 45 carried by the rocker arm 39. These jacks 44, 45 act on first arms of respective tilting means 46, 47 with two opposite arms articulated about axes 48, 49 and acting by their second arm on the slides 43. These slides 43 may or may not come into engagement with respective upper abutments 51, 52 so as to fix the positions of the plate cylinders 9, 10 when they are in the printing active position. These abutments 51, 52 can be adjusted in the horizontal and longitudinal direction by means of a threaded horizontal rod 53 rotatively driven by any suitable means. Each of the jacks 44, 45 pushes back the slide 43 downwardly so that the tapes 23 of the plate cylinder 9, 10 come into engagement with the tapes 19 of the blanket cylinder 11, this engagement corresponding to the printing transfer normal pressure between the plate and blanket. In the case shown in FIG. 1, the right hand jack 45 is put under pressure, and each slide 43 carrying the right hand plate cylinder 10 is bearing against the right hand abutment 52. On the contrary, the other left hand jack 44 is out of pressure, and the slides 43 carrying the left hand plate cylinder 9 are retracted below the left hand abutment 51.

The assembly of the jacks 41, 42 and abutments 51, 52 is disposed and set so that, when the rocker arm 39 comes to bear on one of these abutments 51 or 52 and when the blanket cylinder 11 rolls, tape on tape, with the plate cylinder 9 or 10, the contact of this plate cylinder with the touching cylinder 5 corresponds to a good inking and to a good moistening.

The blanket cylinder 11 includes on its shaft an encoder 54 with three functions, that is to say : transmission of a counting pulse, transmission of a cyclic code for each turn of the printing cylinder and transmission of an incremental pulse train. The counting pulse controls an electronic counter 55 the function of which is to deliver sequence pulses with preset counts. The pulses of the cyclic code synchronize the operation of an electronic registration device 56 with the cycle of the machine. The electronic registration device 52 receives, on the other hand, pulses transmitted by detectors 57, 58 actuated by cams 59, 61 carried by the plate cylinders 9, 10. The electronic information from the counter 55 and from the electronic registration device 56 is introduced into a programmable automation 62 which governs all the sequential controls of the apparatus.

The operation of the apparatus according to the invention is the following one : the encoder 54 activates the electronic counter 55 of the down-counting type, the recycling of which is automatic at passage of zero on a preset count corresponding to the numbers of formats to be printed. This counter 55 transmits a pulse when it has reached a count preset to a value which enables to all the sequences of the series change to have enough time to be carried out. This pulse is transmitted for example 250 cycles prior to the end of the printing of the current series (zero of the counter). It will be assumed that the right hand plate cylinder 10 is then in a printing position, as it is shown in FIG. 1, and that the left hand plate cylinder 9, which is then stopped, has been fitted out with its new plate. The left hand plate cylinder 9 is then bearing on the left hand starting cylinder 25.

The pulse transmitted by the electronic counter 55, 250 cycles prior to the end of the printing, activates the clutch 34 and consequently this causes the left hand starting cylinder 25 and left hand plate cylinder 9 which is tangent thereto to be driven into rotation. The peripheral speed of these two cylinders increases until it reach the value of the peripheral speed of the blanket cylinder 11. This same impulse starts the electronic registration device 56, the function of which is to find out, through the pulses transmitted by the cam 61 and detector 58 and by action of the servomotor 38 on the differential system 37, a perfect register between the left hand plate cylinder 9 and the blanket cylinder 11. When this registration is reached, that is to say when the two cylinders 9 and 11 are angularly keyed one with respect to the other in the correct positions for printing, the electronic registration device 56 transmits a synchronization signal which causes the starts of a plurality of operations in sequence. These successive operations are the following: (1) Meshing of the left hand plate cylinder 9 with the blanket cylinder 11 by means of the jack 44 fed from the bottom. The pressure of this jack 44 is at that moment preset to a pressure sufficient for providing the meshing of the two cylinders 9 and 11 together, but yet insufficient for putting them under pressure. (2) Deactivation of the clutch 34 and stoppage of the operation of the electronic registration device 56. (3) When, the counter 55 reaches the count zero and consequently upon its recycling for a new printing, a control is provided for the release of the pressure in the right hand jacks 42 and 45, the setting under pressure of the left hand jack 41, which causes then the tilting of the rocker arm 39 in the clockwise direction about the axis of the blanket cylinder 11 and consequently the coming in engagement of the left hand plate cylinder 9 with the touching cylinder 5, and the setting to a high pressure of the jack 44. From that moment, the printing goes on with the left hand plate cylinder 9 which has been tilted to the printing position in which it is in engagement under pressure both with the upper touching cylinder 5 and with the lower blanket cylinder 11, and this without the printing line having been stopped. This printing is transferred without interruption by the same blanket 12 which was used for the preceding printing, and this without interruption in the distribution of ink and water. The right hand plate cylinder 10 is, due to the release of the jack 45, disengaged from the blanket cylinder 11 ; it stops rotating and comes to bear on the right hand starting cylinder 26. Its plate can thus be changed and a new printing cycle can be started again later on.

I claim:

1. An offset printing apparatus operating in tandem including a frame having an upper portion on which are mounted an inking device and a moistening device for respectively applying a film of ink and a film of moistening liquid on a touching cylinder having a horizontal axis and rotatively mounted on the frame and having a lower portion on which are rotatively and tangently mounted a blanket cylinder and counter-cylinder, with a web to be printed passing therebetween, and having axes which extend horizontally and transversely and therefore perpendicularly to the web to be printed, the axis of the blanket cylinder and the axis of the touching cylinder being placed in a same vertical plane, and wherein it further includes two plate cylinders having horizontal and transverse axes placed respectively on either side of a vertical plane passing through the axes of the touching cylinder and blanket cylinder, a support mounted at a level intermediate between the touching cylinder and blanket cylinder, said support being provided for the two plate cylinders and being tiltably mounted about the axis of the blanket cylinder, two starting cylinders having horizontal and transverse axes disposed respectively slightly below and outside with respect to each of the two plate cylinders, and control means for controlling a tilting motion of the support of the two plate cylinders for setting under pressure each of said two plate cylinders and for rotatively driving the starting cylinders in order to bring alternatively each of the two plate cylinders either in a printing position in which the plate cylinder is in contact under pressure both with the upper touching cylinder and with the lower blanket cylinder after having previously started the plate cylinder in rotation at a same peripheral speed as that of the blanket cylinder and having keyed the plate cylinder in an angular position, or in a stopped waiting position in which the pate cylinder is retracted from the touching cylinder and blanket cylinder and is bearing against a corresponding starting cylinder for enabling changing of a printing plate thereof.

2. An apparatus as set forth in claim 1, wherein the blanket cylinder is rotatively driven from a transverse shaft via a train of gears comprising a first, a second and a third gear, the first gear is directly connected to an inking group via the transverse shaft having a rotation which is caused by a main shaft of the apparatus, the second gear is an intermediate gear, while the third gear is fixed to the blanket cylinder and has a pitch diameter which corresponds exactly to a diameter of flanges rigidly connected to the blanket cylinder, and the plate cylinder which intervenes in a printing operation of a current series is rotatively driven from the blanket cylinder via a gear rigidly connected to the blanket cylinder and a gear rigidly connected to the plate cylinder, the gears connected to the blanket cylinder and to the plate cylinder each having a pitch diameter identical to the pitch diameter of the third gear, each of the two plate cylinders being rigidly connected to flanges which are bearing, in the printing position, on the flanges of the blanket cylinder.

3. An apparatus as set forth in claim 1, wherein the two starting cylinders are rotatively driven from the blanket cylinder via a transmission mechanism including a chain passing on a toothed wheel rigidly connected to a shaft of the blanket cylinder, on return toothed wheels mounted on the frame of the apparatus, and on toothed wheels each being rigidly connected to an input shaft of an electromagnetic clutch, each said electromagnetic clutch having an output shaft which is coupled to a shaft of one of said starting cylinders, each of the a two starting cylinders further including a differential system controlled by a servomotor.

4. An apparatus as set forth in claim 1, wherein the two plate cylinders are mounted together, at each of their ends, on a same rocker arm which is articulated about the axis of the blanket cylinder and which bears on a pair of vertical jacks, the two plate cylinders being respectively carried on the rocker arm by slides which are pushed under pressure by respective jacks carried by the rocker arm.

5. An apparatus as set forth in claim 4, wherein the jacks act on first arms of respective tilting means having two opposite arms articulated about axes and acting by second arms on the slides, said slides coming in and out of engagement with respective upper abutments so as to fix a position of each of the two plate cylinders when in an active printing position.

6. An apparatus as set forth in claim 5, wherein the upper abutments are settable in an horizontal and longitudinal direction by means of a rotatively driven threaded horizontal rod.

7. An apparatus as set forth in claim 1, wherein the blanket cylinder has a shaft carrying an encoder with three functions, the functions including transmission of a counting pulse, transmission of cyclical code per each turn of the printing cylinder and transmission of an incremental pulse train, wherein the counting pulse controls an electronic counter for delivering sequence pulses with preset counts, the pulses of the cyclical code synchronize operation of an electronic registration device with a cycle of the machine which also receives pulses transmitted by detectors actuated by cams carried by the two plate cylinders.

* * * * *